US009606474B2

(12) United States Patent
Kawasumi

(10) Patent No.: US 9,606,474 B2
(45) Date of Patent: Mar. 28, 2017

(54) DEVELOPING DEVICE

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/809,396

(22) Filed: Jul. 27, 2015

(65) Prior Publication Data

US 2016/0033899 A1 Feb. 4, 2016

(30) Foreign Application Priority Data

Jul. 30, 2014 (JP) ..... 2014-154599

(51) Int. Cl.
*G03G 15/08* (2006.01)

(52) U.S. Cl.
CPC ... *G03G 15/0882* (2013.01); *G03G 2215/088* (2013.01); *G03G 2215/0838* (2013.01)

(58) Field of Classification Search
CPC ..... G03G 15/0844; G03G 15/0881; G03G 15/0882; G03G 15/0886; G03G 2215/0875
See application file for complete search history.

(56) References Cited

U.S. PATENT DOCUMENTS 5,402,216 A * 3/1995 Komaki ..... G03G 15/0868 141/346
8,818,245 B2 8/2014 Takaya et al.
8,989,633 B2 3/2015 Nakajima
2011/0229209 A1* 9/2011 Takaya ..... G03G 15/0844 399/257
2012/0269537 A1* 10/2012 Nakajima ..... G03G 15/0886 399/103

FOREIGN PATENT DOCUMENTS

JP 2004-206088 A 7/2004
JP 2007-219252 A 8/2007
JP 2011-197442 A 10/2011
JP 2012-226128 A 11/2012

* cited by examiner

*Primary Examiner* — Erika J Villaluna

(74) *Attorney, Agent, or Firm* — Fitzpatrick, Cella, Harper & Scinto

(57) ABSTRACT

A developing device detachably mountable to an image forming apparatus includes a developer carrying member and a developer accommodating container including first and second chambers for circulating developer and a supply opening. An openable mechanism maintains a closed state of a discharge opening in the developer accommodating container before initial drive input into the developing device and opens and closes the discharge opening in interrelation with a mounting and demounting operation of the developing device after initial drive of the developing device. The openable mechanism includes a shutter, a spring member for urging the shutter in a closing direction, a sealing sheet for unsealably sealing the discharge opening and for sealing an initial developer in the accommodating container, and a winding-up shaft for winding up the sealing sheet. The sealing sheet is removed from the discharge opening after the initial drive of the developing device.

3 Claims, 9 Drawing Sheets

DEVELOPING DEVICE

FIELD OF THE INVENTION AND RELATED ART

The present invention relates to a developing device for forming a visible image by developing an electrostatic latent image formed on an image bearing member by an electrophotographic process or an electrostatic recording process.

In general, in an image forming apparatus of an electrophotographic type, the electrostatic latent image formed on a photosensitive drum as the image bearing member is developed into a toner image with a developer containing a toner and a carrier by a developing device. In such a developing device, the developer has a lifetime. For example, the toner is consumed by development, but the carrier is little consumed and remains in the developing device, and therefore the carrier deteriorates with use of the developing device, so that a deterioration of a charging performance of the carrier is caused. For this reason, a developing device of a so-called trickle development type in which a fresh (new) developer is supplied and at the same time an excessive developer containing a deteriorated developer is discharged has been conventionally known (e.g., Japanese Laid-Open Patent Application 2011-197442).

Here, the developer discharged from the developing device is collected in a collecting container or the like, and the developing device is provided with a discharge opening for permitting discharge of the developer. In many cases, such a discharge opening conventionally has a constitution in which the discharge opening is not covered in a state before use. In Japanese Laid-Open Patent Application 2011-197442, a shutter capable of adjusting an amount of the developer to be discharged through the discharge opening is provided in order to suppress a fluctuation in amount of the developer even when a screw for feeding the developer is switched by a change in system speed.

In recent years, when the image forming apparatus is installed, as consideration for a user, not only shortening of an installation time but also shortening of an installation procedure have been required. As one method thereof, the image forming apparatus is shipped in a state in which all of the units such as a developing device are mounted in advance inside the image forming apparatus, and only a power source is turned on in a place where the image forming apparatus is installed, so that the image forming apparatus is actuated immediately.

However, in a conventional constitution, a discharge opening for the developer is open even in a state in which the developing device is mounted in the image forming apparatus and is not used. For this reason, during transportation until the image forming apparatus reaches the place where the user uses the image forming apparatus, there was a problem that although the developer inside the developing device does not deteriorate, the developer is discharged through the discharge opening.

As a countermeasure thereto, for example, it would be considered that a mechanism in which a shutter capable of opening and closing the discharge opening is provided and then is opened after the image forming apparatus is installed in the place where the user uses the image forming apparatus while using a constitution in which the shutter is closed even when the developing device is mounted in the image forming apparatus during transportation is employed. In this case, when an image forming operation is not performed, the shutter is closed. For this reason, there is a need to open and close the shutter every image forming operation, so that there is a liability that the image forming apparatus becomes completed.

SUMMARY OF THE INVENTION

The present invention has accomplished in view of the above circumstances. A principal object of the present invention is to provide a developing device, having a discharge opening, capable of suppressing discharge of an initial developer through the discharge opening during shipping of an image forming apparatus by a simple constitution while enabling the shipping of the image forming apparatus in a state in which the initial developer is confined in the developing device.

According to an aspect of the present invention, there is provided a developing device detachably mountable to a main assembly of an image forming apparatus, comprising: a developing container for accommodating a developer containing a toner and a carrier; a developer carrying member for carrying the developer in the developing container to develop a latent image formed on an image bearing member; a feeding member for feeding the developer in the developing container; a supplying portion for supplying the developer into the developing container; a discharge opening for permitting discharge of an excessive developer, resulting from supply of the developer into the developing container, to an outside of the developing container; a sealing member for sealing the discharge opening to prevent leakage of an initial developer in the developing container; and a removing mechanism for removing the sealing member from the discharge opening by being driven with drive of the feeding member or the developer carrying member.

These and other objects, features and advantages of the present invention will become more apparent upon a consideration of the following description of the preferred embodiments of the present invention taken in conjunction with the accompanying drawings.

DESCRIPTION OF THE EMBODIMENTS

An embodiment of the present invention will be described with reference to FIGS. 1-9. First, a general structure of an image forming apparatus in this embodiment will be described with reference to FIGS. 1-3.

[Image Forming Apparatus]

Figure 1:
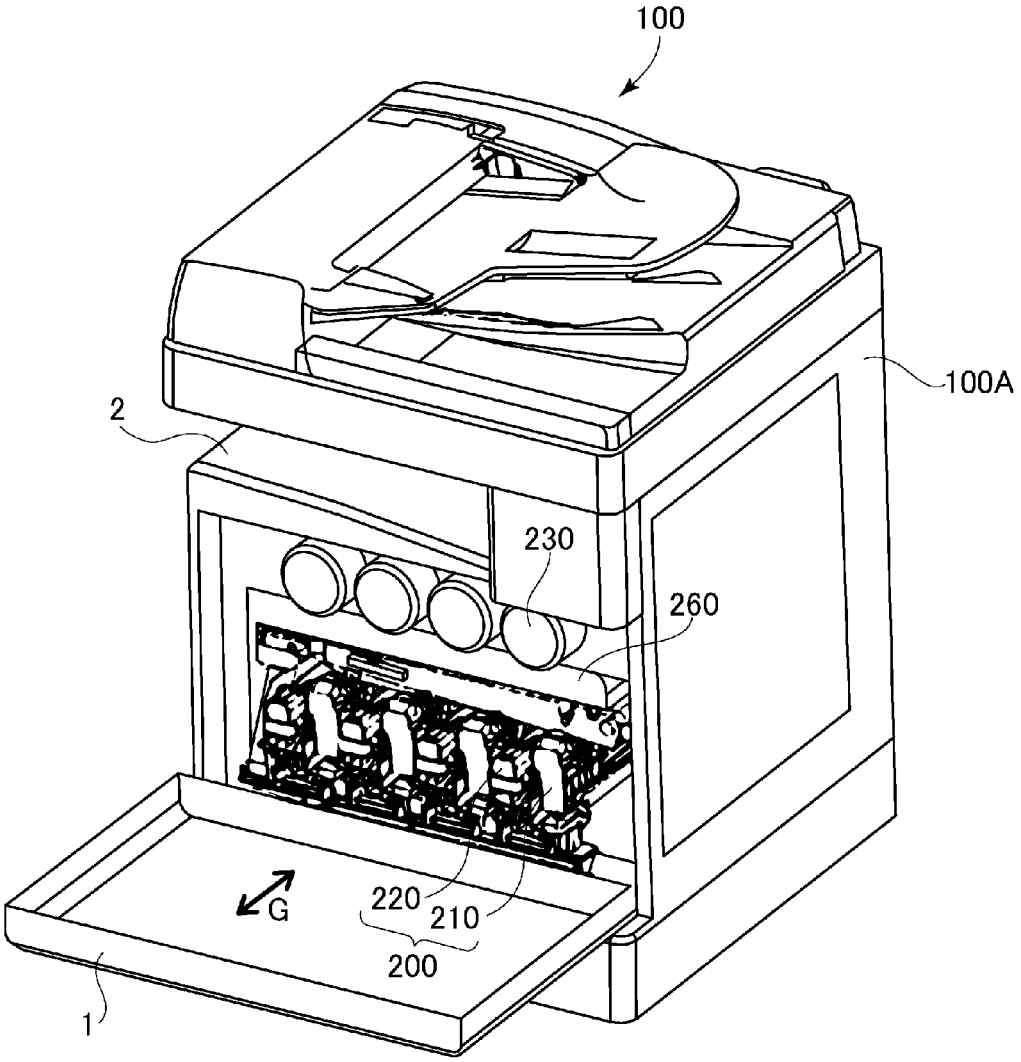
FIG. 1 is a perspective view showing an image forming apparatus in an embodiment of the present invention in a state in which a front cover is open.

FIG. 1 shows an entirety of an image forming apparatus 100 in a state in which a front cover 1 is opened to show an arrangement of units inside the image forming apparatus 100. The image forming apparatus 100 in this embodiment includes four process units (image forming portions) 200 each consisting of a drum unit 210 including a photosensitive drum 211 and a developing device (developing unit) 220 including a developing sleeve 221 provided opposed to the photosensitive drum 211. The four process units 200 form toner images of Y (yellow), M (magenta), C (cyan) and K (black), respectively, and are arranged in a substantially horizontal direction at a substantially central portion of an apparatus main assembly 100A of the image forming apparatus 100. The process units themselves have the same constitution and therefore only the rightmost unit is represented by reference numerals 200, 210 and 220, and other units are omitted from indication of the reference numerals.

Above the respective process units 200, an intermediary transfer unit 260 is provided. The intermediary transfer unit 260 includes an intermediary transfer belt as an intermediary transfer member, and the intermediary transfer belt is provided to oppose each of the photosensitive drums 211. The intermediary transfer belt is stretched by unshown rollers such as a secondary transfer roller, an idler roller, a tension roller. Further, the tension roller or the idler roller is driven, so that the intermediary transfer belt is rotationally driven. At a position opposing each photosensitive drum 211 via the intermediary transfer belt, a primary transfer roller is provided, and by applying a primary transfer bias to the primary transfer roller, the toner image is primary-transferred from each photosensitive drum 211 onto the intermediary transfer belt. A secondary transfer roller forms a secondary transfer portion (nip) between itself and an opposite roller provided opposed thereto via the intermediary transfer belt. By applying a secondary transfer bias between the secondary transfer roller and the opposite roller, the toner image is secondary-transferred from the intermediary transfer onto a recording material fed to the secondary transfer portion. The recording material is a sheet material such as paper (sheet) or an OHP sheet.

Above the intermediary transfer unit 260, four toner cartridges 230 for supplying toners of respective colors are arranged in parallel. Further, in a rear side of the apparatus main assembly 100A, a toner supplying unit 231 (FIG. 5) to which the toner is supplied from the toner cartridge 230 and from which the toner is delivered to the developing device 220 is provided. At a lower-front portion of the apparatus main assembly 100A, as described later, a collecting toner feeding unit 232 (FIG. 6) for receiving and collecting the developer discharged from the developing device 220 is provided. Incidentally, the front side in which the front cover 1 of the apparatus main assembly 100A is disposed is a side in which a user operates the image forming apparatus 100 and an operating panel and the like are provided. On the other hand, the rear side of the apparatus main assembly 100A is a side opposite from the front side, and in which a substrate for controlling various devices, and a power source, a motor and the like are provided.

The image forming apparatus 100 further includes a laser unit 240 (FIG. 3) as an exposure device and a cassette below the respective process units 200, and includes a fixing device along a recording material feeding path provided at a side portion and a discharge tray 2 provided at an upper portion of the image forming apparatus 100, and the like. Each of the drum unit 210, the developing device 220 and the intermediary transfer unit 260 is detachably mountable to the apparatus main assembly 100A. For this purpose, the image forming apparatus 100 is provided with the above-described front cover 1 as an access door to an inside of the image forming apparatus 100. During mounting and demounting of the developing device 220 and the drum unit 210 and exchange of these units, an objective unit is exposed by opening the front cover 1 from the front side of the main assembly, so that the unit can be inserted into and pulled out in an arrow G direction indicated in FIG. 1.

[Process Unit]

Figure 2:
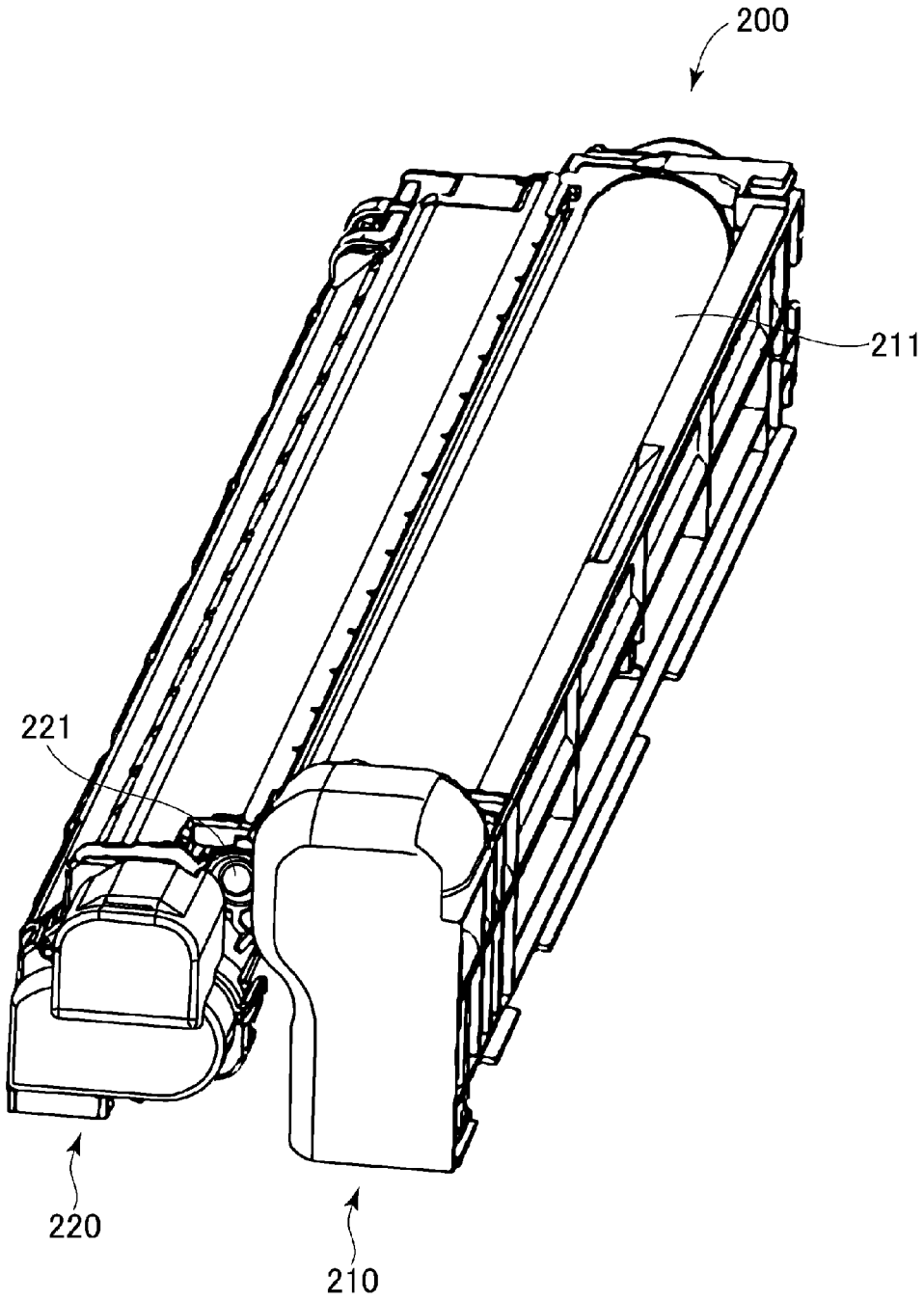
FIG. 2 is a perspective view of a process unit in the embodiment.

A structure of each of the above-described process units 200 will be described with reference to FIGS. 2 and 3. First, the drum unit 210 includes the photosensitive drum 211 as an image bearing member, and includes a charging roller 212 as a charging device, a cleaning device 213 and the like at a periphery of the photosensitive drum 211. On the other hand, the developing device 220 includes a developing container 222 accommodating the developer containing a toner and a carrier, and at an opening formed at a position of the developing container 222 opposing the photosensitive drum 211, a cylindrical developing sleeve 221 as a developer carrying member is rotatably supported.

A process for forming, e.g., a four-color based full-color image by the image forming apparatus 100 including the process unit 200 constituted as described above will be described. First, when the image forming operation is started, the surface of the photosensitive drum 211 rotating in an arrow direction in FIG. 3 is uniformly charged by the charging roller 212. Then, the photosensitive drum 211 is exposed to laser light L, corresponding to an image signal, emitted from the laser unit 240. As a result, the electrostatic latent image depending on the image signal is formed on the photosensitive drum 211. The electrostatic latent image formed on each photosensitive drum 211 is developed with the toner accommodated in the developing device 220, thus being visualized as a visible image. In this embodiment, a reverse developing method in which the toner is deposited at a light-portion potential portion exposed to the laser light is used. The toner image formed on the photosensitive drum 211 is primary-transferred onto the intermediary transfer belt. The toner (transfer residual toner) remaining on the surface of the photosensitive drum 211 after the primary transfer is removed by the cleaning device 213.

Such an operation is successively performed at the respective process unit 200 for yellow, cyan, magenta and black, so that the four color toner images are superposed on the intermediary transfer belt. Thereafter, the recording material accommodated in a cassette (not shown) is fed to the secondary transfer portion in synchronism with toner image formation timing. The four color toner images on the intermediary transfer belt are then collectively secondary-transferred onto the recording material at the secondary transfer portion.

Then, the recording material is fed to the fixing device 13 (not shown), and is subjected to heat and pressure, so that the toner on the recording material is melted and mixed, and thus a full-color image is fixed on the recording material. Thereafter, the recording material is discharged onto the discharge tray 2. As a result, a series of the image forming process is ended. Incidentally, by using only a desired image forming portion, it is also possible to form an image of a desired single color or a plurality of colors.

[Developing Device]

Next, using FIGS. 3 and 4, a detailed structure of the developing device 220 in this embodiment will be described.

The developing device 220 includes the developing sleeve 221 and the developing container 222, and in the developing container 222, a two-component developer containing the toner and the carrier is accommodated as the developer. The developing device in this embodiment employs a so-called trickle developing method, as described later, in which a fresh developer is supplied and at the same time an excessive developer in the developing container is discharged. The developing sleeve 221 is disposed close to the photosensitive drum 211 with a predetermined interval. Inside the developing sleeve 221, an unshown magnet is provided, and the developer is carried on the developing sleeve 221 by a magnetic force of the magnet.

Here, with respect to the developer, a two-component developing method is used as a developing method, and a negatively chargeable non-magnetic toner and a magnetic carrier are mixed and are used as the developer. The non-magnetic toner is prepared by incorporating a colorant, a wax component and the like into a resin material such as polyester or styrene-acrylic resin and then by a pulverizing or polymerizing the mixture to obtain powder. The magnetic carrier is prepared by coating a resin material on a surface layer of a core formed of resin particles obtained by kneading ferrite particles or magnetic powder.

Further, the developing container 222 is partitioned into a developing chamber 224 (first chamber) and a stirring chamber 225 (second chamber) by a partition wall 223, and the developer is accommodated in each of the developing chamber 224 and the stirring chamber 225. The developing chamber 224 and the stirring chamber 225 are adjacent to each other with respect to the substantially horizontal direction. Both ends of the partition wall 223 do not reach side walls of the developing container 222 at longitudinal end portions of the inside of the developing container 222. As a result, at both end portions of the partition wall 223, communication openings 223*a*, 223*b*for permitting passing of the developer (communication) between the developing chamber 224 and the stirring chamber 225 are formed, so that a circulation path of the developer is formed by the developing chamber 224 and the stirring chamber 225.

The developing chamber 224 and the stirring chamber 225 include a first screw 226 and a second screw 227, respectively, as a circulating and feeding member for circulating the developer between the developing chamber 224 and the stirring chamber 225. That is, in the developing chamber 224, the first screw 226 as a feeding member for feeding the developer while supplying the developer from the developing chamber 224 to the developing sleeve 221 is disposed in parallel to a rotational axis direction of the developing sleeve 221. By rotation of the first screw 226, the developer in the developing chamber 224 is fed in an arrow α direction in FIG. 4. In the stirring chamber 225, the second screw 227 for feeding the developer supplied by the toner supplying unit 231 as described above while stirring the developer is disposed in parallel to the rotational axis direction of the developing sleeve 221. By rotation of the second screw 227, the developer in the stirring chamber 225 is fed in an arrow β direction in FIG. 4 opposite to a developer feeding direction of the first screw 226. Each of the first screw 226 and the second screw 227 is constituted by being provided with a helical blade on a rotation shaft thereof. In this way, the developer is fed between the developing chamber 224 and the stirring chamber 225 while being stirred, so that the toner and the carrier are charged to the negative polarity and the positive polarity, respectively.

Figure 3:
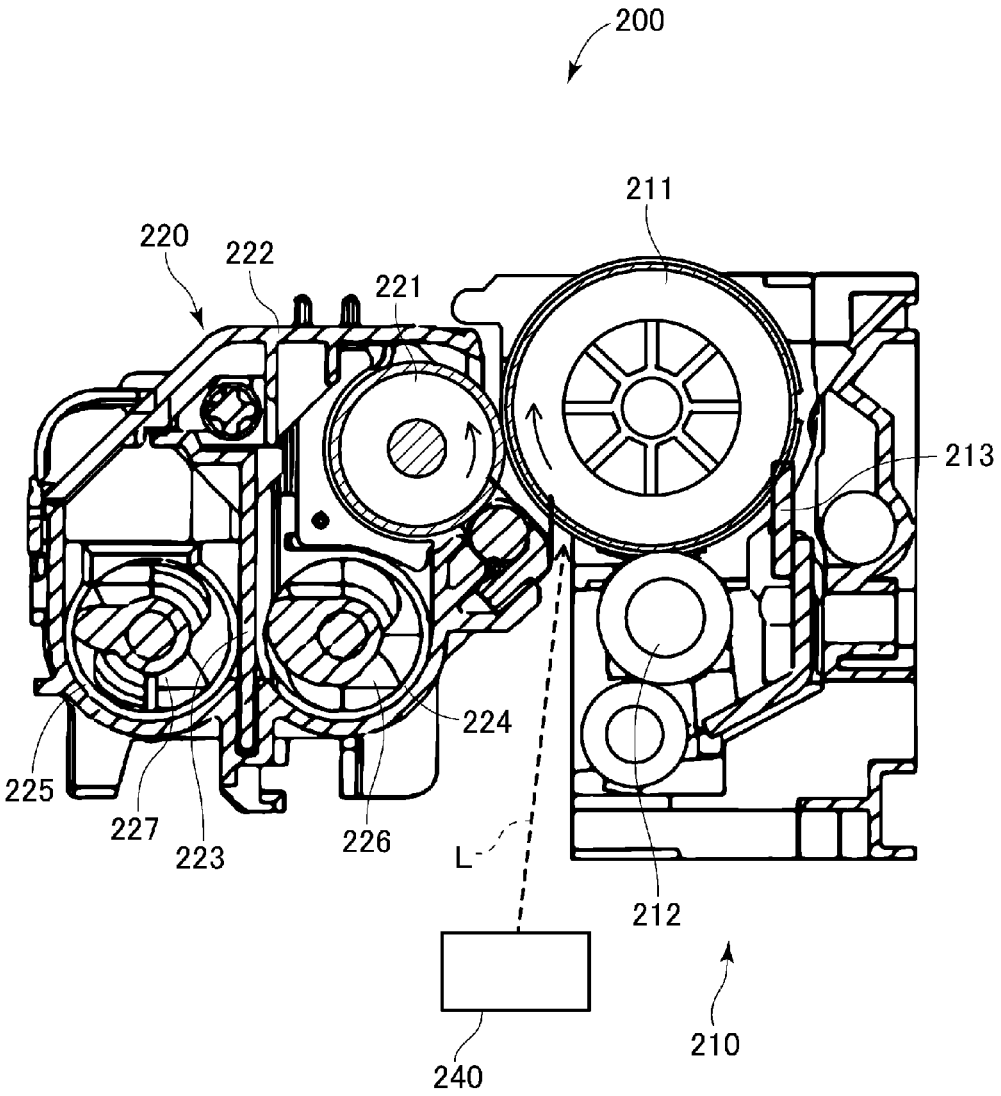
FIG. 3 is a cross-sectional view of the process unit in the embodiment.

The developing sleeve 221 rotates in an arrow direction in FIG. 3, and feeds the developer in a direction toward a blade as a developer regulating member while carrying the developer accommodated in the developing chamber 224. Then, the developer carried on the developing sleeve 221 undergoes a shearing force by the blade, so that an amount thereof is regulated and thus a developer layer having a predetermined thickness is formed on the developing sleeve 221. The developer layer is carried and fed to a developing region opposing the photosensitive drum 211, and develops the electrostatic latent image formed on the surface of the photosensitive drum 211. The developer after being subjected to the development is separated by the developing sleeve 221 and is collected in the developing chamber 224.

[Supply of Developer]

Figure 4:
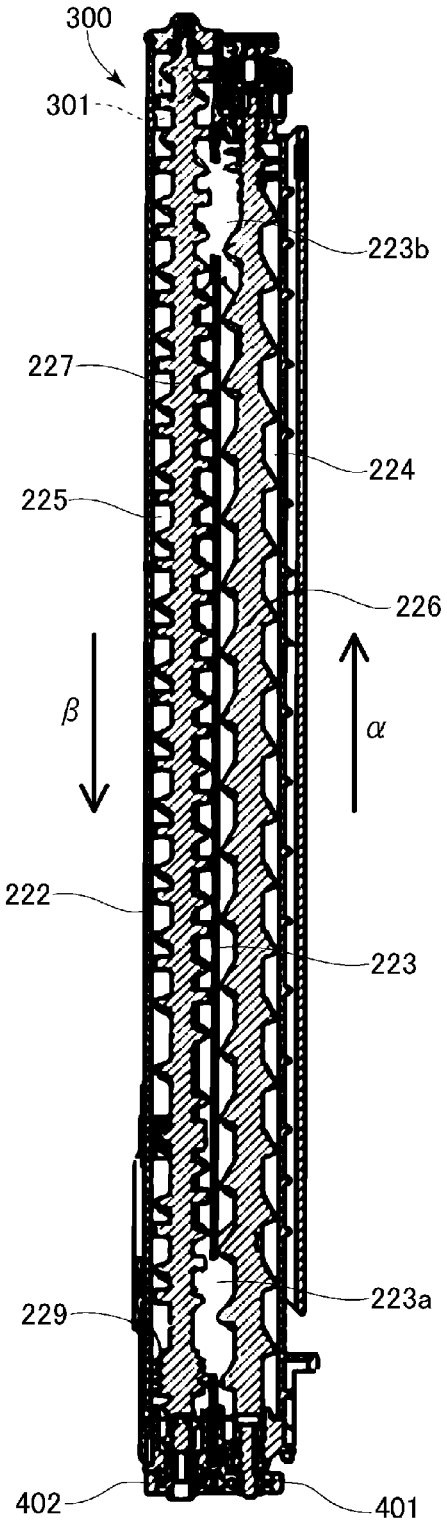
FIG. 4 is a longitudinal sectional view of a developing device in the embodiment.
Figure 5:
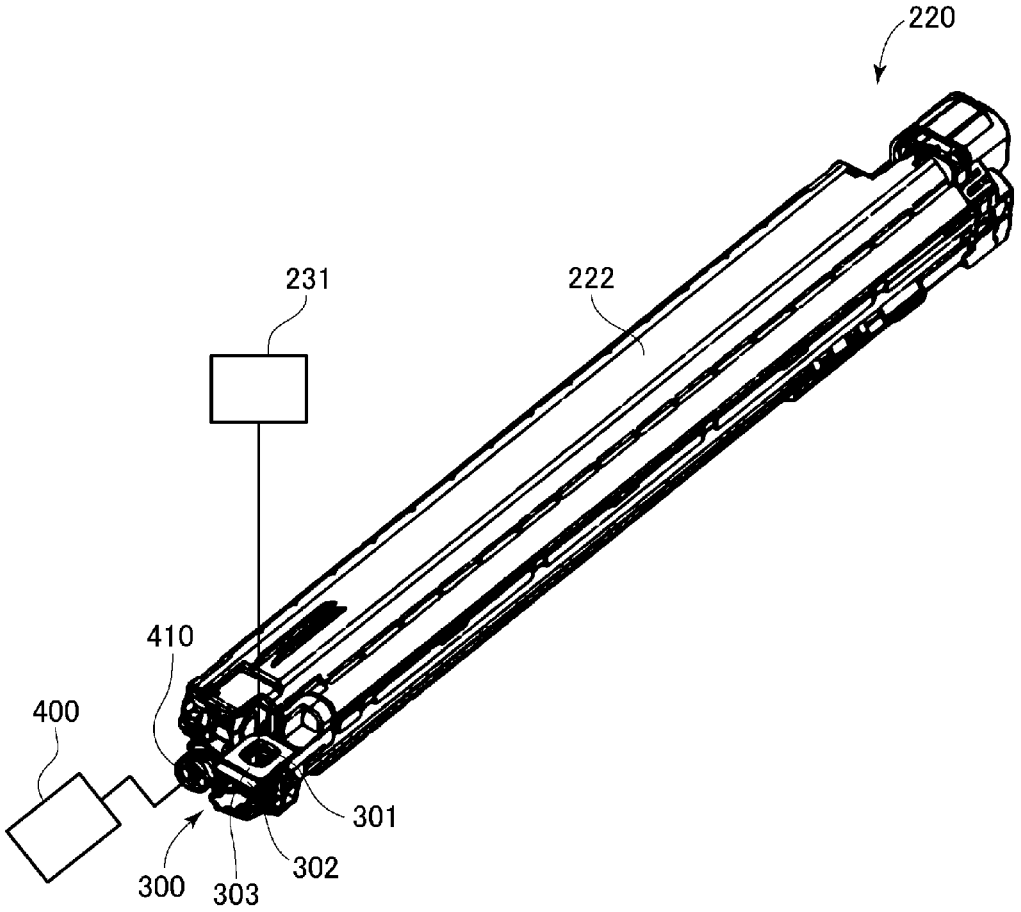
FIG. 5 is a perspective view of the developing device in the embodiment as seen from above.

Further, as shown in FIGS. 4 and 5, a supplying portion 300 for supplying the developer containing the toner and the carrier into the developing container is provided upstream of the communication opening 223*b* of the stirring chamber 225 with respect to the developer feeding direction of the second screw 227. The supplying portion 300 is positioned at the rear portion of the apparatus main assembly 100A in a state in which the developing device 220 is mounted in the apparatus main assembly 100A, and includes a supply opening 301 which opens to above the second screw 227. To the supplying portion 300, the developer is supplied from the toner supplying unit 231 as a supplying means provided in the apparatus main assembly 100A. That is, as shown in FIG. 1, above the developing device 200, the toner cartridge 230 in which a developer for supply is accommodated is disposed, and the developer is supplied from the toner cartridge 230 to the toner supplying unit 231. The toner supplying unit 231 includes a supplying screw as a developer feeding member, and an end of the supplying screw extends to a position of the supply opening 301.

The developer in an amount corresponding to an amount of the developer consumed by image formation is supplied from the toner supplying unit 231 to the stirring chamber 225 through the supply opening 301 by a rotational force of the supplying screw and gravitation of the developer. The developer supplied to the stirring chamber 225 is fed in the stirring chamber 225 by the rotation of the second screw 227. The amount of the supply developer is roughly determined by the number of rotations of the supplying screw as the feeding member, but this number of rotation is determined by an unshown toner supply amount controlling means. As a method of controlling the toner supply amount, a method of optically or magnetically detecting a toner content (concentration) of the two-component developer and a method in which a reference latent image on the photosensitive drum 211 is developed and a density of a resultant toner image (patch image) is detected, and the like method have been known. Accordingly, either of these methods can be selected appropriately. For example, an inductance sensor for magnetically detecting the toner content of the developer in the developing container 222 is provided. Then, a detection result of this induction sensor and a detection result of the patch image are used in combination, and then the developer is supplied.

Further, the supplying portion 300 includes, as shown in FIG. 5, a supply shutter 302 capable of opening and closing the supply opening 301 and a seal 303 for sealing a connecting portion between the supply opening 301 and the toner supplying unit 231 in a connected state between the supply opening 301 and the toner supplying unit 231. The supplying portion 300 includes an unshown spring for urging the supply shutter 302 in a shielding direction, and in a state in which the developing device 220 is demounted from the apparatus main assembly 100A, the supply shutter 302 is urged by the spring, so that the supply opening 301 is shielded. On the other hand, when the developing device 220 is mounted in the apparatus main assembly 100A, the supply shutter 302 is engaged with an unshown engaging portion provided on the toner supplying unit 231, so that the supply shutter 302 is moved in an open direction against an urging force of the spring. Then, in a state in which the supply opening 301 is opened, the supply shutter 302 is connected with the toner supplying unit 231 in a state in which the supply opening 301 is open.

[Discharge of Developer]

As described above, the developer supplied to the inside of the stirring chamber 225 through the supplying portion 300 is fed by the rotation of the second screw 227 while being stirred, so that the toner and the carrier are triboelectrically charged by friction therebetween. Then, the developer is further fed and is used for the development. By such supply of the developer, the amount of the developer in the developing container 222 increases, and therefore in this embodiment, a discharging portion 310 for discharging a part of the developer (excessive developer) in the developing container 222 is provided. That is, of the developer, the toner is used for the development, but the carrier is not used for the development and remains in the developing container 222. Then, the carrier gradually deteriorates, so that a charging performance of the developer lowers. For this reason, a part of the developer is discharged by the discharging portion 310, so that not only the amount of the developer in the developing container 222 is maintained in a predetermined range but also the deteriorated carrier is discharged.

Figure 6:
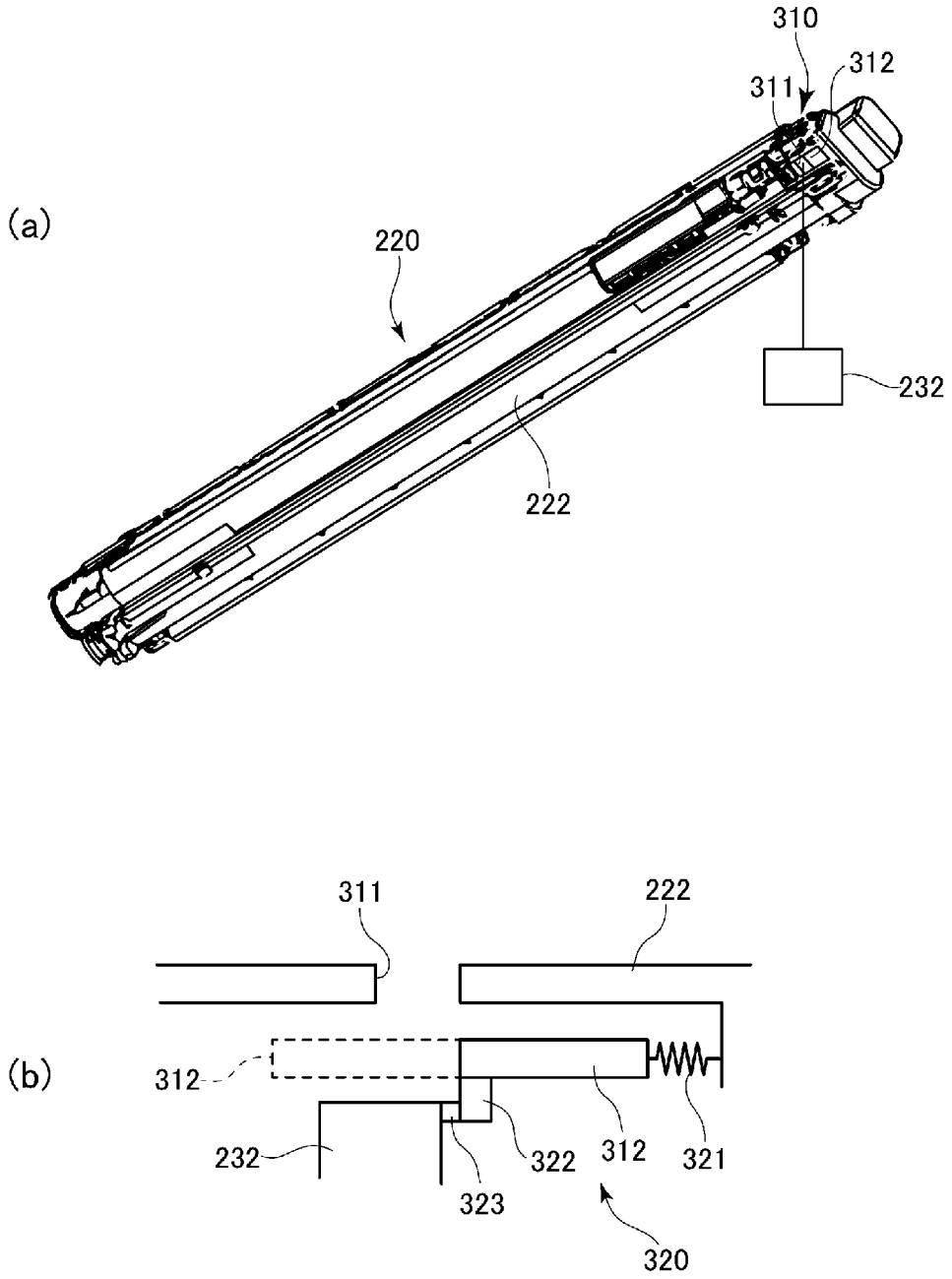
FIG. 6, (*a*) is a perspective view of the developing device in the embodiment as seen from below, and (*b*) is a schematic view of an opening and closing structure of a discharge (discharge opening) shutter.
Figure 7:
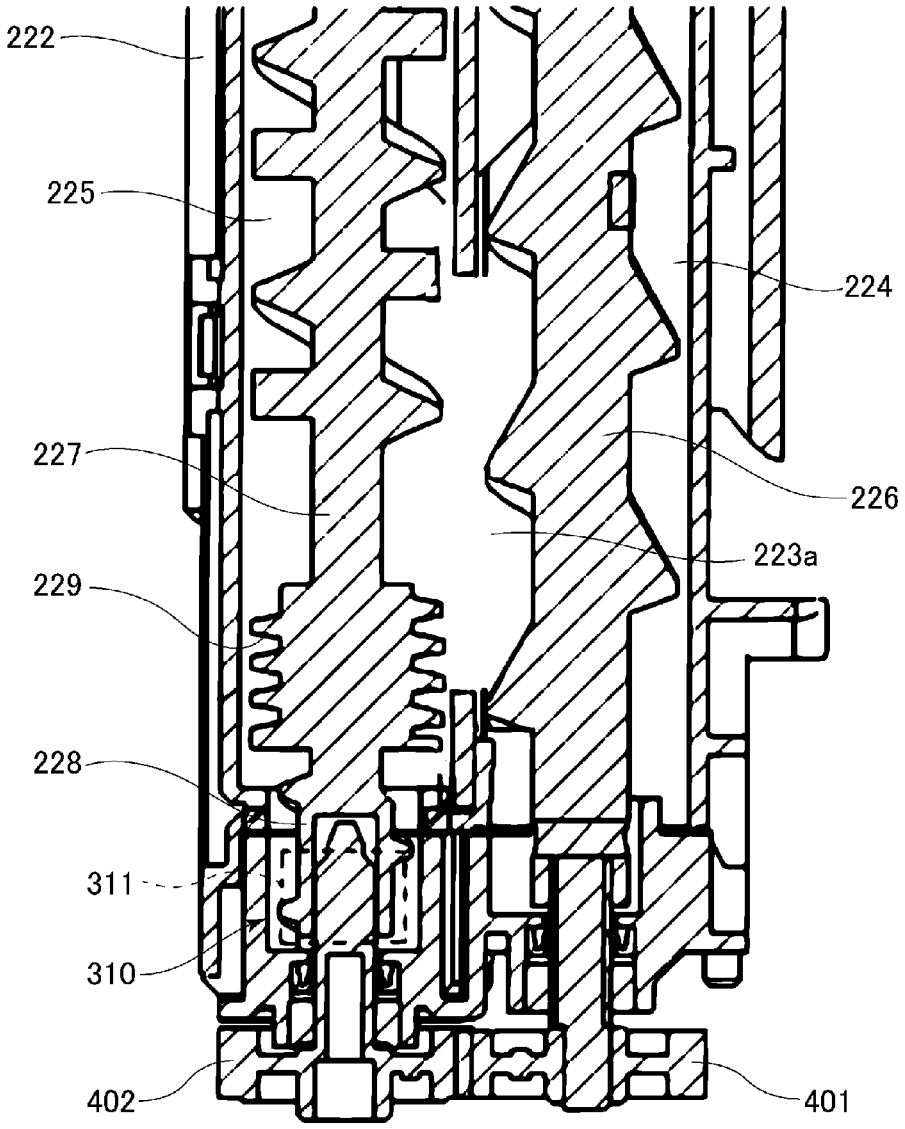
FIG. 7 is an enlarged longitudinal sectional view of the developing device in the embodiment in the neighborhood of a discharge opening.

The discharging portion 310 is, as shown in (*a*) of FIG. 6 and FIG. 7, provided downstream of the communication opening 223*a* of the stirring chamber 225 with respect to the developer feeding direction of the second screw 227. The discharging portion 310 is positioned at the front portion of the apparatus main assembly 100A in a state in which the developing device 220 is mounted in the apparatus main assembly 100A, and includes a discharge opening 311 below the second stirring chamber 225. That is, in this embodiment, the discharge opening 311 opens to below the developing container 222 with respect to the direction of gravity. As shown in FIG. 7, in the discharging portion 310, a discharging screw 228 is provided integrally with the second screw 227 so that the developer fed into the discharging portion 310 is discharged to the outside through the discharge opening 311.

Further, a returning screw 229 is provided integrally with the second screw 227 as an upstream portion of the discharging portion 310, so that the developer fed by the second screw 227 in the stirring chamber 225 is pushed back to be fed (delivered) into the developing chamber 224 through the communication opening 223*a*. A part of the developer fed by the second screw 227 rides over the returning screw 229 to reach the discharging portion 310, so that the developer is discharged by the discharging screw 228 through the discharge opening 311. That is, when the amount of the developer in the developing container increases, an excessive developer pressure is applied to a downstream end portion of the second screw 227 correspondingly, so that the developer in an amount corresponding to an amount in excess of a returning force by the returning screw 229 further moves toward the downstream side, and then is discharged to the outside of the developing container 222. When the excessive developer is discharged, the developer pressure at the downstream end portion of the second screw 227 lowers, so that the discharge of the developer steps. As a result, the amount of the developer inside the developing container 222 is stabilized in a certain range.

The discharging portion 310 is connected, in the state in which the developing device 220 is mounted in the apparatus main assembly 100A, with a collected toner feeding unit 232 as a connecting means provided in the apparatus main assembly 100A. Then, the developer discharged through the discharge opening 311 as described above is collected in the collected toner feeding unit 232, and then is fed into an unshown collecting container.

The discharging portion 310 includes, as shown in FIG. 6, the discharge shutter 312 as the shutter member capable of opening and closing the discharge opening 311. The discharge shutter 312 is disposed outside a sealing sheet, as a sealing member described later, relative to the discharge opening 311, and is movable between a shielding position where the discharge shutter 312 shields the discharge opening 311 and an open position where the discharge opening 311 opens. Such a discharge shutter 312 is, as shown in (*b*) of FIG. 6, moved by a moving mechanism 320 as a shutter moving mechanism.

The moving mechanism 320 includes a spring 321 as an urging member for urging the discharge sheet 312 to the shielding position and an engaging portion 322 provided on the discharge shutter 312. During the mounting of the developing device 220 in the apparatus main assembly 100A, the discharge sheet 312 is moved to the open position against the urging force of the spring 321 by engagement of the engaging portion 322 with a portion-to-be-engaged 323 provided on the collected toner feeding unit 232. On the other hand, when the developing device 220 is not mounted in the apparatus main assembly 100A, the discharge shutter 312 is moved to the shielding position by the urging force of the spring 321.

In this embodiment, the developing device 220 is, as described above, mountable in and demounted from the apparatus main assembly 100A and exchangeable. For this reason, when the developing device 220 is not mounted in the apparatus main assembly 100A, the supply shutter 302 and the discharge shutter 312 shield the supply opening 301 and the discharge opening 311, respectively, so that the developer inside the developing container is sealed.

[Sealing Sheet]

Figure 8:
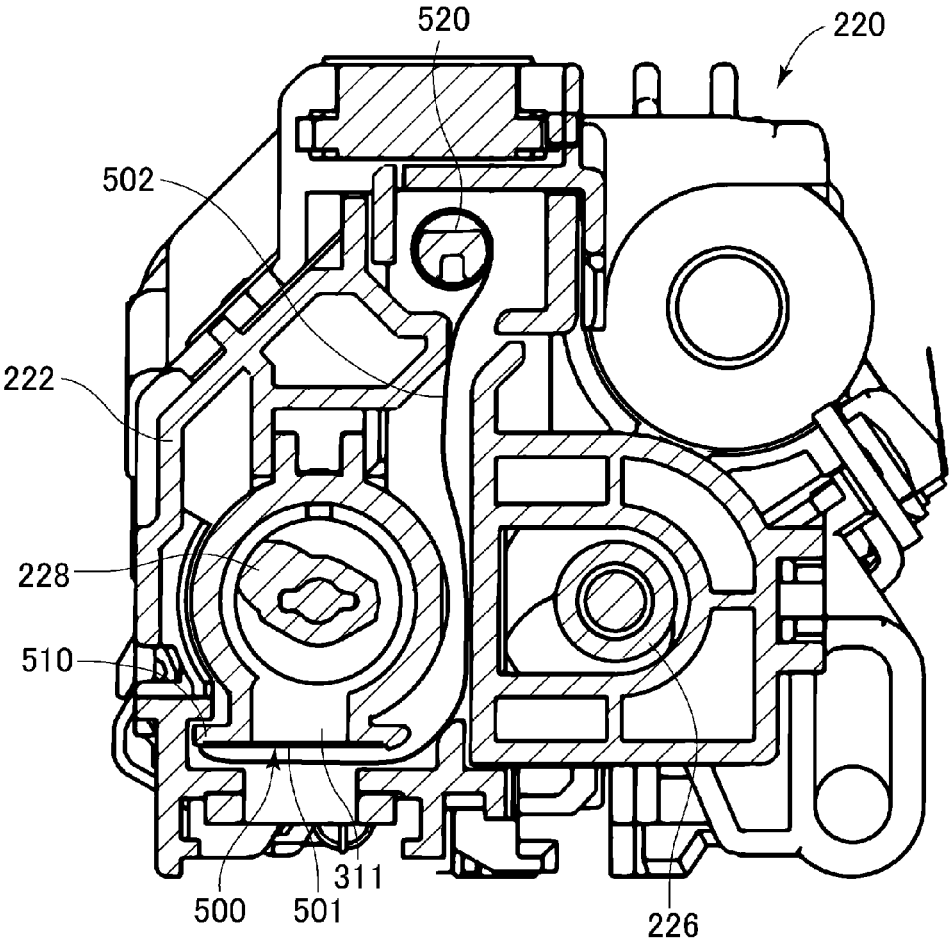
FIG. 8 is a cross-sectional view of the developing device in the embodiment cut along the discharge opening.
Figure 9:
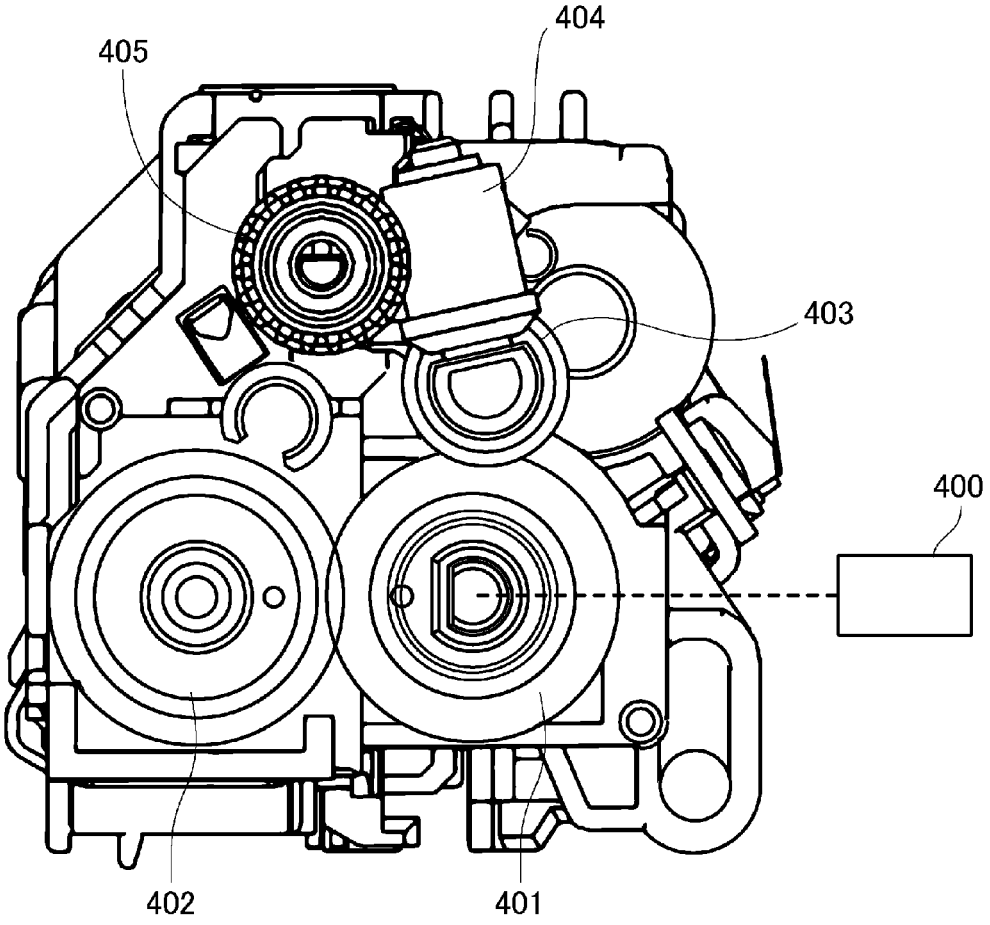
FIG. 9 is a schematic view showing a driving structure for removing a sealing sheet for the developing device in the embodiment.

A sealing structure of the discharge opening 311 of the developing device 220 will be described with reference to FIGS. 8 and 9. FIG. 8 is a sectional view of the developing device 220 at a front surface (front side of the apparatus main assembly 100A during the mounting) crossing the discharge opening 311, and FIG. 9 is a sectional view of the inside of the developing device 220 from which the front cover is removed and shows a gear train for effecting removal drive of the sealing sheet 500 described later.

With respect to the image forming apparatus, as described above, in order to shorten the installation time, during shipping as a product, the image forming apparatus is shipped and transported in a state in which the various units such as the developing device and the drum unit are mounted in advance inside the image forming apparatus. The developing device 220 in this embodiment includes, as described above, the discharge opening 311 and the discharge shutter 312, and in the state in which the developing device 220 is mounted in the apparatus main assembly 100A, the discharge sheet 312 is in the open position. At this time, if the discharge opening 311 is not sealed, the inside developer rides over the returning screw 229 to reach the discharge opening by vibration, tilting and the like of the developing device during the transportation of the image forming apparatus, with the result that there is a possibility that the developer is unexpectedly discharged. In the case where a degree of unexpected discharge of the developer is large, there is a possibility that at the time of an initial operation of the image forming apparatus after the installation of the image forming apparatus, the inside developer becomes insufficient to cause image defect or the like. This leads to unusefulness of such an advantage of a lifetime extension of the developing device of the trickle type having the constitution with the discharge of the developer.

Therefore, in this embodiment, in an initial state of the developing device 220, between the discharge opening 311 and the discharge shutter 312, the sealing sheet 500 as the sealing member is further provided. Accordingly, for example, in the case where the image forming apparatus is shipped after the developing device 220 is mounted in advance in the apparatus main assembly 100A, the discharge opening 311 is sealed with the sealing sheet 500. Here, the sealing sheet 500 is removed when the image forming apparatus is driven, but in the case where a user removes the sealing sheet 500 by hand(s), for example, the number of steps of an installing procedure of the image forming apparatus undesirably increases. Further, in some cases, the user forgets the removal of the sealing sheet 500. For this reason, in this embodiment, a constitution in which the sealing sheet is removed by initial drive of the developing device is employed. In the following, this constitution will be specifically described.

The sealing sheet 500 is a thin sheet material, and is a film using, e.g., polyester, nylon or polyethylene as a base material and has a lamination structure in which a plurality of layers are formed by lamination. The thickness of the sealing sheet 500 is about 100-200 μm. The sealing sheet 500 is, as shown in FIG. 8, extended horizontally to seal the discharge opening 311 inside the developing device 220 so as to oppose the discharging screw 228. Further, the sealing sheet 500 is fixed to a bearing surface 510 of the developing container 222 by an irreversible means such as bonding or welding. As a result, the discharge opening 311 is sealed with the sealing sheet 500 before the image forming apparatus is initially driven. The initial drive refers to the case where the developing device 220 is first driven after the image forming apparatus in which a new developing device 220 is mounted in advance is installed or after the new developing device 220 is mounted in the apparatus main assembly 100A.

The sealing sheet 500 has an elongated step shape and is removable from the discharge opening 311 by being wound up by a winding-up shaft 520 as a removing mechanism (removing means, winding-up means). For this purpose, the sealing sheet 500 includes a covering portion 501 for covering the discharge opening 311 and a connecting portion 502 which is folded back from an end portion (left end portion in FIG. 8) of the covering portion 501 to the winding-up shaft 520. The winding-up shaft 520 winds up the connecting portion 502, and removes the sealing sheet 500 from the discharge opening 311 in a manner that the sealing sheet 500 is first removed from the one end portion of the covering portion 501. That is, the covering portion 501 is fixed, from a free end portion (right end portion in FIG. 8) to the one end portion, on the bearing surface 510 at a periphery of the discharge opening 311 by welding or the like. The connecting portion 502 is continuously extended from the one end portion of the covering portion 501 at one end portion thereof, and is connected with the winding-up shaft 520 at the other end portion thereof. Accordingly, by rotation of the winding-up shaft 520, winding-up of the connecting portion 502 is started, so that the covering portion 501 is peeled off from the one end portion and thus is removed from the discharge opening 311.

The winding-up shaft 520 is rotatably supported by the developing container 222, and at a shaft end thereof, as shown in FIG. 9, a driving gear 405 is fixed. This driving gear 405 is driven via a gear train as shown in FIG. 9 by a motor 400 as a driving source. The motor 400 is provided at the rear portion of the apparatus main assembly 100A, and as shown in FIG. 5, in the state in which the developing device 220 is mounted in the apparatus main assembly 100A, the motor 400 is connected with a driving portion 410 provided on a rear surface of the developing device 220. The driving portion 410 is a driving means for driving the first screw 226 as the feeding member. That is, the driving portion 410 is connected not only with the first screw 226 but also with a rotatable member, via a coupling, which is provided in the apparatus main assembly 100A side and which is rotated by the motor 400, so that the driving portion 410 transmits a rotational force of the motor 400 to the first screw 226.

With an end portion of the first screw 226 at the front end portion of the developing device 200, a driving gear 401 is connected. Further, between the driving gears 401 and 405, a gear 403 and a worm 404 are provided so that a rotational force of the driving gear 401 is transmitted to the driving gear 405 by a gear train constituted as described above. Accordingly, the driving gear 405 is rotated via the driving gear 401, the gear 403 and the worm 404 by rotationally driving the first screw 226 by the motor 400, so that the winding-up shaft 520 is rotated. That is, the winding-up shaft 520 is driven by the driving portion 410 as a driving means for driving the first screw 226 as the feeding member.

Incidentally, a gear 402 is connected with the second screw 227 disposed in the stirring chamber 225, and is rotated by engaging with the driving gear 401, so that the gear 402 rotationally drives the second screw 227. Accordingly, the first screw 226 and the second screw 227 rotate in synchronism with each other by the drive of the motor 400. Further, the developing sleeve 221 may also be rotated in synchronism with the first screw 226 by the drive of the motor 400 and may also be rotationally driven alone by another motor.

As described above, the sealing sheet 500 is wound up by the rotation of the winding-up shaft 520, and therefore the winding-up shaft 520 is rotated by driving the motor 400 in order to initially drive the developing device 220, so that winding-up of the sealing sheet 500 is started. Then, by further rotation of the winding-up shaft 520, the covering portion 501 of the sealing sheet 500 is peeled off from the bearing surface 510, so that the sealing sheet 500 is removed from the discharge opening 311 and thus the discharge opening 311 communicates with the connected toner feeding unit 232. After the sealing sheet 500 is removed from the discharge opening 311, the sealing sheet 500 is wound up by the winding-up shaft 520 by further rotation of the winding-up shaft 520.

In such a constitution in this embodiment, a sealed state of the discharge opening 311 will be described in a time-series manner of a product operation. First, in the state in which the developing device 220 is not mounted in the apparatus main assembly 100A, both of the discharge shutter 312 and the sealing sheet 500 shield the discharge opening 311, so that the developer does not leak out. Then, by mounting the developing device 220 in the apparatus main assembly 100A, the discharge shutter 312 opens, but a driving force has not been inputted, and therefore the sealing sheet 500 still shields the discharge opening 311, so that the developer does not leak out.

Thereafter, the image forming apparatus 100 in which the developing device 220 is mounted in advance is installed at the place where the user uses the image forming apparatus 100, and then when the driving force is inputted by start of an initial operation (i.e., when the developing device is initially driven), the sealing sheet 500 is wound up in interrelation therewith, so that the sealing sheet 500 is removed from the discharge opening 311. Thus, the developer is capable of being discharged through the discharge opening 311. Finally, when the developing device 220 is exchanged due to an end of the lifetime of the developing device 220 or the like reason, the developing device 220 is pulled out from the apparatus main assembly 100A, so that the discharge shutter 312 shields the discharge opening 311. At this time, the sealing sheet 500 cannot shield again the discharge opening 311 since the sealing sheet 500 is kept in a wound-up state, but the discharge shutter 312 shields the discharge opening 311, and therefore the developer does not leak out.

As described above, according to this embodiment, the sealing sheet 500 is removed from the discharge opening 311 by the initial drive of the developing device, and therefore the number of steps of the installation procedure of the image forming apparatus can be reduced. Specifically, when the image forming apparatus 100 in which the new developing device 220 is mounted in advance is installed at the place where the user uses the image forming apparatus 100, there is no need to perform a special operation for removing the sealing sheet 500 from the discharge opening 311. That is, the user may only be required to actuate the image forming apparatus 100, and the developing device 220 is driven by the actuation of the image forming apparatus 100, so that the sealing sheet 500 is automatically removed. For this reason, the installation procedure can be reduced in the number of steps, and it is possible to avoid an error or the like caused due to forgetting to eliminate the shielding of the discharge opening 311.

Further, in a state before the installation, such as during the transportation or the like of the image forming apparatus 100 in which the new developing device 220 is mounted in advance, the sealing sheet 500 seals the discharge opening 311, and therefore it is possible to prevent the developer from leaking out in this state. Particularly, as in this embodiment, in the case of the constitution in which the discharge opening 311 opens downward with respect to the direction of gravity, the developer is liable to leak out during the transportation, and therefore as in this embodiment, a constitution in which the discharge opening 311 is sealed with the sealing sheet 500 is effective. Further, the developing device 220 can be mounted in advance in the image forming apparatus 100 as described above, and therefore the installation time can be shortened. As described above, according to this embodiment, it is possible to shorten the installation time and the installation procedure of the image forming apparatus while employing the trickle type for realizing the lifetime extension of the developing device.

<Other Embodiments>

In the above-described embodiment, the constitution using the sealing sheet 500 as the sealing member for sealing the discharge opening 311 was described. However, the constitution of the sealing member is not limited thereto. For example, such a constitution that entirety of the sealing member is not required to be formed of the sheet material, and a thin plate-like shutter member is formed at an end portion of the sheet and slides when the sheet is wound up may also be employed. Further, other than the above-described winding-up means, as the removing means for removing the sealing member, such a constitution that the sealing member is slid in interrelation with the drive of the developing device may also be employed, for example.

Further, in the above-described embodiment, the constitution in which the removing means interrelates with the drive of the first screw as the feeding member was described, but the removing means may also interrelate with the drive of the developing sleeve as the developer carrying member. That is, the removing means may also be driven by the driving means for driving the developing sleeve.

Further, also the constitution of the developing device is not limited to that described above but may also be another constitution. For example, in the above-described embodiment, the constitution of the horizontal stirring type in which the developing chamber and the stirring chamber are arranged in the substantially horizontal direction was described, but the present invention is also applicable to a constitution of a vertical stirring type in which the developing chamber and the stirring chamber are arranged in an up-down (vertical) direction. Further, in the above-described embodiment, the constitution in which the supply of the developer to the developing sleeve and the collection of the developer from the developing sleeve are performed in the developing chamber was described. However, the present invention is also applicable to a constitution of a so-called function separation type in which the supply of the developer to the developing sleeve is made from the developing chamber and the collection of the developer from the developing sleeve is made in the stirring chamber.

Further, in the above-described embodiment, the discharge opening for permitting discharge of the developer is caused to open downward with respect to the direction of gravity, but the present invention is also applicable to a constitution in which the discharge opening is caused to open toward another side such as a side along the horizontal direction. Further, also with respect to the developer discharging constitution, other than the constitution in which the developer which ridden over the returning screw, the present invention is also applicable to a constitution in which the developer is caused to overflow a discharge opening provided at a predetermined height position of the developing container.

According to the present invention, the sealing member is removed from the discharge opening by the initial drive of the developing device, and therefore it is possible to realize reduction in the number of steps of the installation procedure of the developing device.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-154599 filed on Jul. 30, 2014, which is hereby incorporated by reference herein in its entirety.

What is claimed is:

1. A developing device detachably mountable to an image forming apparatus, comprising:

a developer carrying member rotatably provided for carrying a developer containing a toner and a carrier to develop a latent image;

a developer accommodating container for rotatably supporting said developer carrying member and for accommodating the developer supplied to said developer carrying member, said accommodating container including a first chamber for accommodating the developer and a second chamber for forming a feeding path for circulating the developer between itself and the first chamber;

a first feeding member for feeding the developer in said first chamber;

a second feeding member for feeding the developer in said second chamber;

a supply opening, provided on said accommodating container, for permitting supply of the developer;

a discharge opening, provided on said accommodating container for permitting discharge of excessive developer supplied through said supply opening;

a shutter, provided at an outer surface of said developer accommodating container, for opening and closing said discharging opening;

a sealing sheet, at an inner surface of said developer accommodating container, for unsealably sealing said discharge opening and for sealing an initial developer in said accommodating container; and a winding-up shaft, provided above said first feeding member in a state in which said developing device is mounted in said image forming apparatus, for winding up the sealing sheet to remove the sealing sheet from said discharge opening after the initial drive of said developing device;

wherein said winding-up shaft winds up the sealing sheet so as to pass through a space below said first feeding member and between said first feeding member and said second feeding member.

2. A developing device according to claim 1, wherein said developing device is configured to be capable of being shipped in a state in which said developing device is mounted in a main assembly of the image forming apparatus.

3. A developing device according to claim 1, wherein said winding-up shaft is driven by drive inputted into said first feeding member.

* * * * *